US005464029A

United States Patent [19]

Rentz

[11] Patent Number: 5,464,029

[45] Date of Patent: Nov. 7, 1995

[54] MANICURE WORK STATION

[76] Inventor: Rosemary Rentz, 1818 Lashley St., Longmont, Colo. 80501

[21] Appl. No.: 92,240

[22] Filed: Jul. 15, 1993

[51] Int. Cl.[6] ..... A45D 29/18

[52] U.S. Cl. ..... 132/73.5; 132/73; 454/56

[58] Field of Search ..... 132/73.5, 73; 312/138.1, 312/196; 160/354; 454/56

[56] References Cited

U.S. PATENT DOCUMENTS

| | | | |
|---|---|---|---|
| 1,102,060 | 1/1914 | Leach | 312/138.1 X |
| 1,755,113 | 4/1930 | Grom | 132/73 |
| 1,977,386 | 10/1934 | Holes | 454/56 |
| 2,147,314 | 2/1939 | Percy | 132/73 |
| 3,056,968 | 10/1962 | Fitzpatrick | 132/73 X |
| 3,318,076 | 5/1967 | Baker | 454/56 X |
| 4,202,676 | 5/1980 | Pelosi et al. | 454/56 X |
| 4,312,291 | 1/1982 | Knab | 454/56 X |
| 4,505,190 | 3/1985 | Fink et al. . | |
| 4,561,903 | 12/1985 | Blaul | 454/56 X |
| 4,639,035 | 1/1987 | Isaacson | 160/368.1 X |
| 4,647,295 | 3/1987 | Christ . | |
| 4,852,468 | 8/1989 | Harris | 132/73 X |
| 5,074,348 | 12/1991 | Phillips | 160/368.1 X |
| 5,112,373 | 5/1992 | Pham . | |

FOREIGN PATENT DOCUMENTS

| | | | |
|---|---|---|---|
| 343296 | 9/1904 | France | 454/56 |
| 402697 | 12/1933 | United Kingdom | 132/73 |

*Primary Examiner*—Kenneth J. Dorner
*Assistant Examiner*—David E. Allred
*Attorney, Agent, or Firm*—Rick Martin

[57] ABSTRACT

A work station consisting of an environmental chamber and base unit especially suited for use by a manicurist in the preparation of nails and in the application of nail polish. The environmental chamber is fully enclosed to prevent noxious fumes from escaping. The noxious fumes are evacuated by a quiet, low volume exhaust motor and fan. The environmental chamber is enclosed by a transparent top cover supported by a pair of end walls and a pair of flexible curtains allowing the client and the manicurist to insert their hands into the enclosed space. The top cover provides an enclosed space allowing the collection of nail dust and providing eye protection for the client and manicurist. The environmental chamber is supported by a base unit. The base unit provides storage drawers for the supplies of the manicurist, a lamp to illuminate the work area and magnifying lens to aid the manicurist in observing the work area.

10 Claims, 4 Drawing Sheets

MANICURE WORK STATION

FIELD OF INVENTION

The present invention relates to an environmental chamber and base unit especially suited for use by a manicurist in the preparation of nails and in the application of nail polish.

BACKGROUND OF THE INVENTION

This invention relates to a work station especially suited for use by a manicurist in the preparation of nails and in the application of nail polish. The manicure work station consists of an environmental chamber and base unit.

The treatment of human nails for aesthetic purposes may involve the application of a liquid acrylic, a liquid adhesive or other material to form a nail-like member.

The nail-like member or the existing nail must be trimmed, cut, and filed to the shape desired. One or more coats of nail polish and/or nail sealer must be applied to complete the nail in a form and finish which is aesthetically pleasing to the client.

The liquid acrylic, the liquid adhesive, the nail polish, the nail sealer, and other liquids employed by the manicurist give off noxious fumes. These fumes are objectionable to the client and manicurist. These fumes may prove harmful to the manicurist if exposed to such fumes over an extended period of time.

The trimming, cutting, and filing of the nails result in and emit nail dust particles which are also objectionable to the client and manicurist. These dust particles may also prove harmful to the manicurist if exposed to such dust particles over an extended period of time. The trimming and cutting of nails may also result in projectiles of small nail fragments posing the danger of eye irritation or damage to both the client and manicurist.

It is the standard practice to permit the noxious fumes and particulate laden air to disperse into the ambient atmosphere without any positive effort to remove these fumes. The nail dust collecting at the base of the work area is occasionally swept away with a small brush. Manicurists are left to their own devices to provide eye protection.

Efforts to remove the noxious fumes, particle laden air, and nail dust particles are known in the prior art. Efforts to provide eye protection in conjunction with the above are also known in the prior art. The prior art has left several problems unsolved. These problems include the cost effectiveness of the inventions, the noise level of the equipment, the inadequate removal of noxious fumes, the inadequate removal of dust particles, and/or the lack of adequate eye protection. A summary of the most relevant prior art follows.

U.S. Pat. No. 4,647,295 (1987) to Christ discloses a work top air cleaner which includes a passageway formed in the work top through which air is removed and directed to a filter box. Christ does not include a hood to provide eye protection for the client and manicurist. This device also requires a minimum blower capacity of 150 cfm in order to capture and direct the noxious fumes toward the down draft filtration system. Such a blower capacity has an inherent noise level objectionable to the client and the manicurist.

U.S. Pat. No. 4,852,463 (1989) to Harris discloses a ventilated work station for sculpting fingernails. The work station includes a desk-like arrangement defining a platform which supports a transparent hood. The transparent hood is fixedly connected to the platform. A down-draft exhaust motor and fan is connected to the hood by ducts. The exhaust motor and fan creates a low pressure zone in the space confined by the hood, evacuating fumes from the work area. Harris is characterized by relatively high cost with regard to the duct work and high capacity motor and fan required for a down-draft system. This device provides no protection for the diffusion of fumes not totally captured by the down-draft exhaust system.

U.S. Pat. No. 5,112,373 (1992) to Pham discloses an apparatus for controlling vapor emissions at a manicure work station. The portable transparent housing unit is movable to different work stations and provides an inert filtration system to disperse the noxious fumes into the ambient atmosphere. Pham provides no protection for the diffusion of fumes not totally captured by the exhaust system. Neither does the device make provisions for the collection of nail dust particles.

Harris discloses a system that most closely resembles the present invention. Harris, however, provides no means for preventing the noxious fumes from escaping through the openings where the client and manicurist must insert their hands. Furthermore, Harris utilizes a down-draft exhaust system requiring expensive ducting and exhaust equipment. Furthermore, Harris uses a system of lighting which obstructs the view of the work area from observation directly above the work area.

None of the patents indicative of the prior art disclose an arrangement of the type set forth with the present invention. Among other things, there is no showing of a fully enclosed environmental chamber hood system to effectively trap all noxious fumes. The present invention provides a fully enclosed environmental chamber to effectively trap all noxious fumes. This allows for the evacuation of the trapped fumes by means of a low volume exhaust motor and fan. Additionally there is no showing in the prior art of a passive collection means for nail dust particles. The present invention provides an absorbent pad or towelette at the base of the environmental chamber to passively collect the nail dust particles.

SUMMARY OF THE INVENTION

The present invention is utilized to effectively control and eliminate noxious fumes, effectively control and collect nail dust particles, and provide a means of protecting the eyes of the client and manicurist at a manicure work station.

The main object of the present invention is to provide a highly efficient, fully enclosed environmental chamber for collecting and dispersing noxious fumes.

Another object of the present invention is to provide a passive collection means for nail dust particles.

Another object of the present invention is to provide a means of eye protection for the client and manicurist.

Another object of the present invention is to provide transparent housing for the environmental chamber.

Another object of the present invention is to provide a clear field of view of the work area.

Another object of the present invention is to provide a quiet, low volume exhaust motor and fan for the evacuation of fumes.

Another object of the present invention is to provide access sides to the environmental chamber whereby the client and the manicurist can insert their hands into the work area.

Another object of the present invention is to provide flexible curtains covering the access sides of the environmental chamber.

Another object of the present invention is to provide flexible curtains capable of contouring the wrists or lower arms of the client and the manicurist.

Another object of the present invention is to provide flexible curtains that can easily be removed for cleansing or disposal.

Another object of the present invention is to provide an absorbent fibrous pad or towelette to collect the nail dust particles.

Another object of the present invention is to provide for the removal of the absorbent pad or towelette.

Another object of the present invention is to provide a base unit for supporting the environmental chamber.

Another object of the present invention is to provide an arm rest for the comfort of the client as a part of the base unit.

Another object of the present invention is to provide for the easy installation of retractable arms to support a lamp and/or magnifying lens on the base unit.

Another object of the present invention is to provide storage drawers for the supplies of the manicurist as a part of the base unit.

A final object of the present invention is to provide a work station with a design resulting in economical construction.

Other objects of this invention will appear from the following description and appended claims, reference being had to the accompanying drawings forming a part of this specification wherein like reference characters designate corresponding parts in the several views.

The present invention incorporates an environmental chamber which is attached to the horizontal surface of a base unit. The environmental chamber and base unit comprise the manicure work station. The environmental chamber includes a pair of spaced end walls. The end walls support a transparent cover extending between the end walls. The transparent cover provides a clear view of the work area.

One end wall is hinged to provide easy access to the interior of the environmental chamber. The hinged access allows for the easy placement and easy removal of an absorbent fibrous pad or towelette located under the environmental chamber. The fibrous pad collects the nail dust particles for later removal.

The hinged end wall also contains a quiet low volume exhaust motor and fan. The exhaust motor and fan effectively produces a low pressure zone in the environmental chamber thereby removing the noxious fumes from the work area.

The client and manicurist place their hands through access openings along each side of the environmental chamber. These openings are loosely sealed with curtains of sufficient weight and flexibility to allow for the insertion of the hands into the environmental chamber yet drape freely over the wrists or lower arms to effectively prevent the noxious fumes from escaping the environmental chamber. These curtains are attached to the edges of the transparent cover by means of hook and loop fasteners such as Velcro®, snaps, or other mechanical fasteners. These hook and loop fasteners, snaps, or other mechanical fasteners allow for the easy removal of the curtains for cleansing or disposal.

The base unit provides for easy placement and attachment of the environmental chamber. The base unit also provides for the attachment of retractable arms to support a lamp and/or magnifying lens sufficient to illuminate and observe the work area. The base unit further provides drawers suitable for storing the supplies of the manicurist.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE PREFERRED EMBODIMENT

Figure 1:
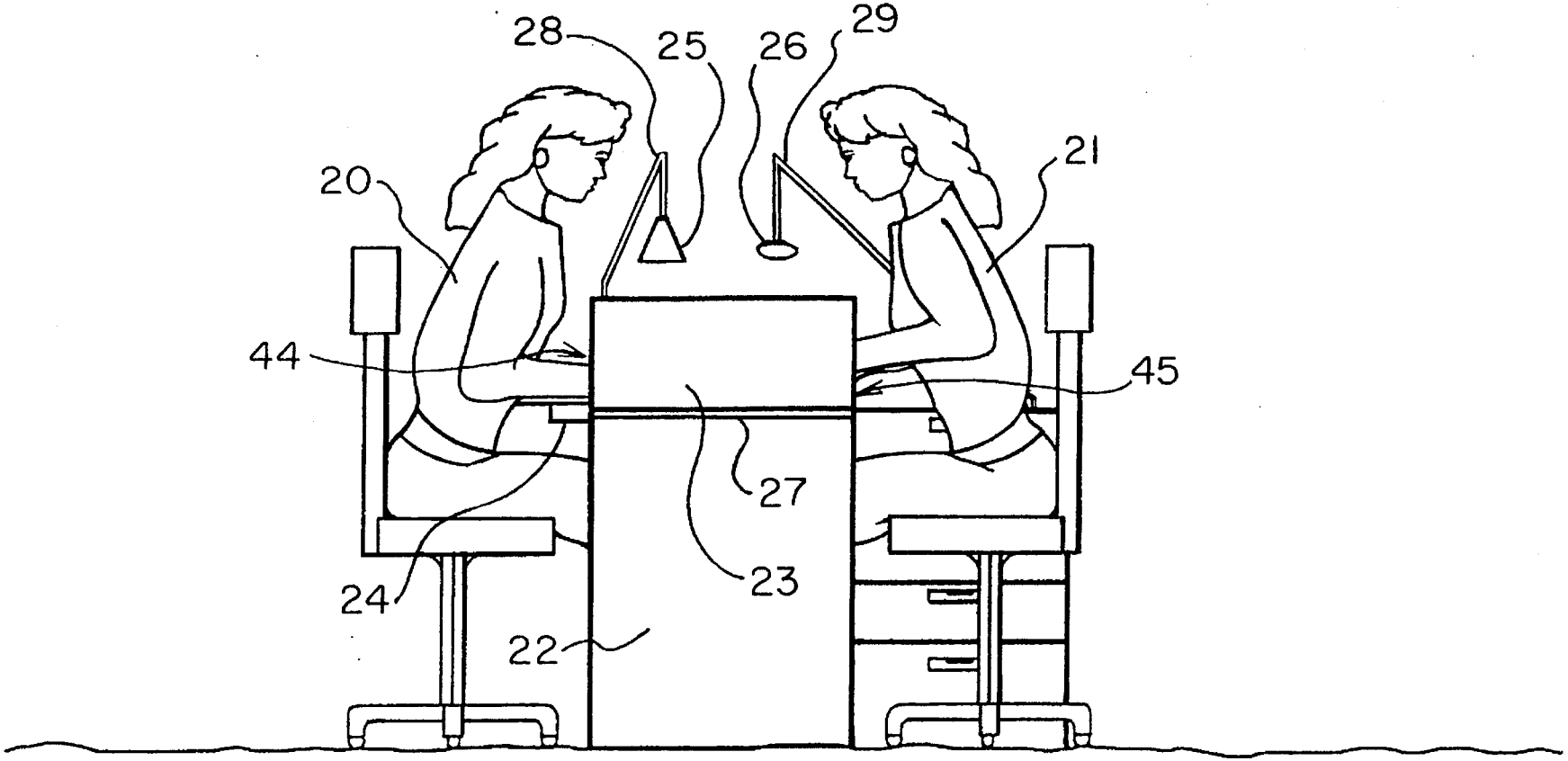
FIG. 1 is a side plan view of the environmental chamber with base unit as utilized.

Referring to FIG. 1 a client 20 and manicurist 21 are seated at a base unit 22. The hands of the client 20 and the manicurist 21 are inserted into an environmental chamber 23 through access sides 44, 45. The base unit 22 is provided with an arm rest 24 for the comfort of the client 20. A lamp 25 and magnifying lens 26 are supported by retractable arms 28, 29 which in turn are supported by a horizontal top 27 of the base unit 22. The lamp 25 and the magnifying lens 26 are positionable via the retractable arms 28, 29 to properly illuminate and observe the work area.

Figure 2:
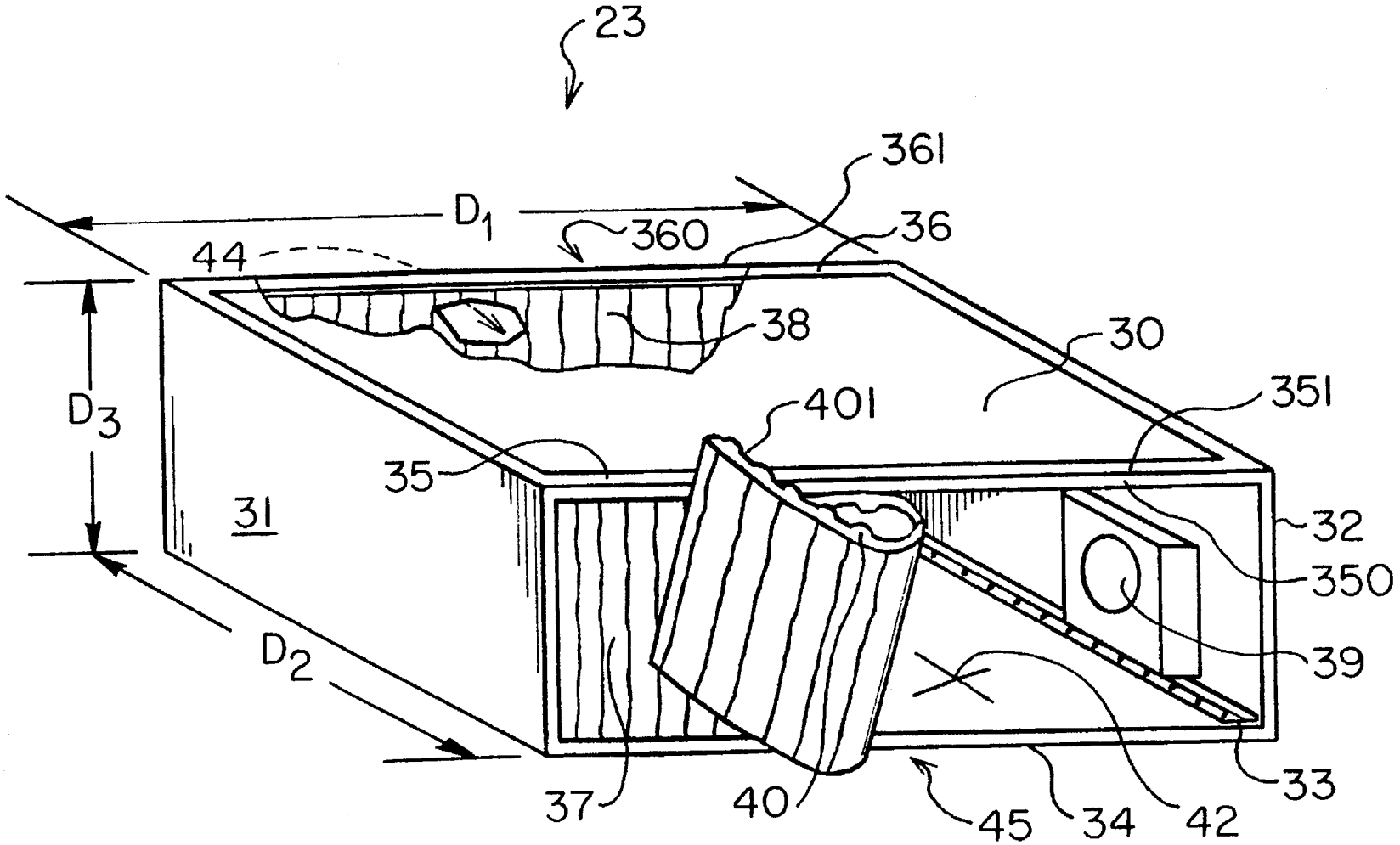
FIG. 2 is a top perspective view of the environmental chamber as shown in FIG. 1 without the base unit.
Figure 3:
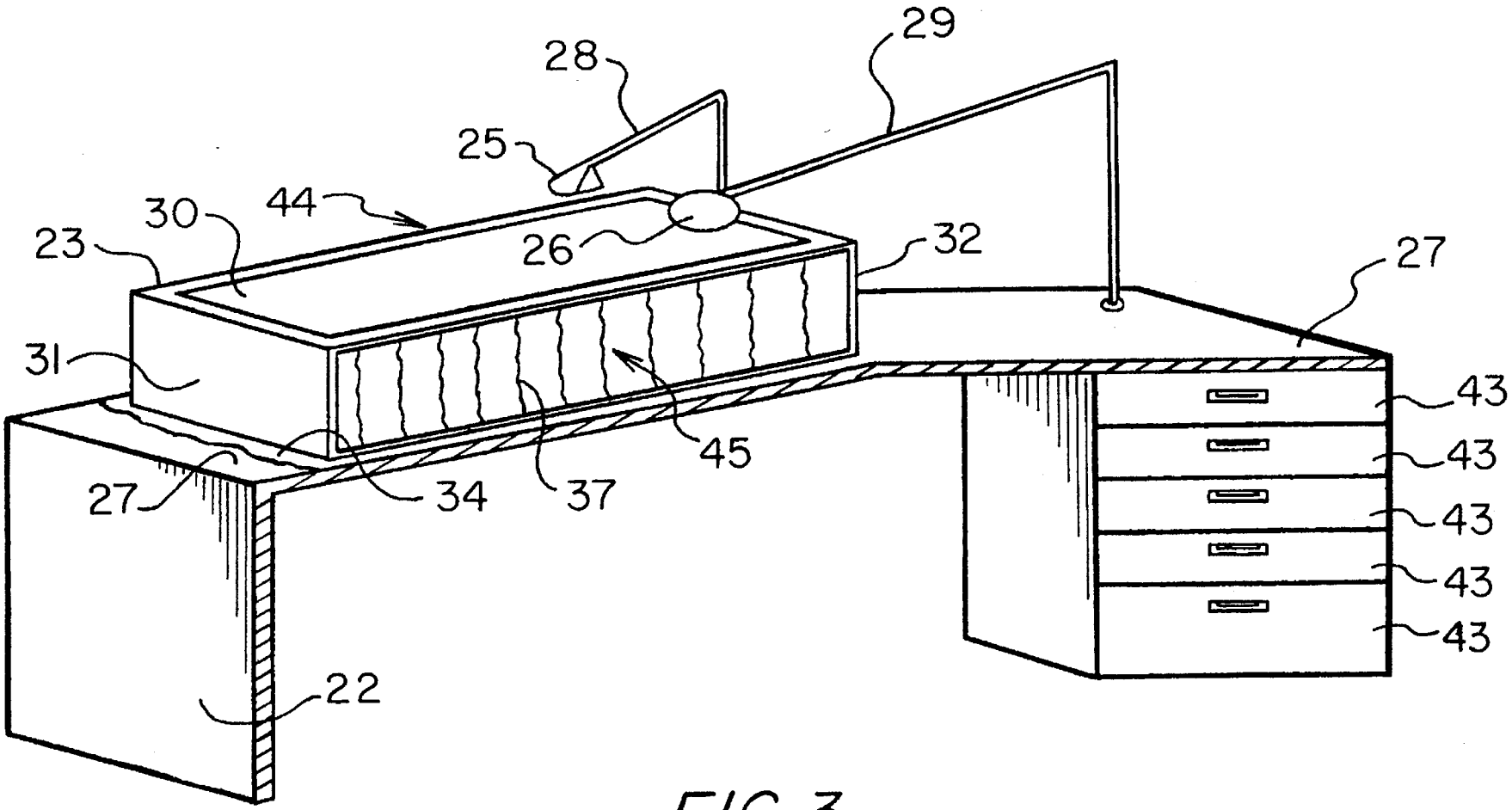
FIG. 3 is a front perspective view of the environmental chamber as shown in FIGS. 1, 2 and base unit as shown in FIG. 1.

Referring next to FIG. 2 details of the environmental chamber 23 are shown. A transparent cover 30 is attached to and supported by end walls 31, 32. The transparent cover 30 can be made of glass or other transparent material suitably treated to resist mechanical and chemical abrasion. A hinge 33 attaches the end wall 32 to the horizontal top 27 (FIGS. 1, 3, 4) of the base unit 22 (FIGS. 1, 3). The hinge 33 allows the environmental chamber 23 to rotate upward to an open position. The open position allows access to an absorbent fibrous pad or towelette 34. The absorbent fibrous pad or towelette 34 can be removed for cleansing or disposal.

The side edges 350, 360 of the transparent cover 30 are provided with mechanical fasteners 35, 36 which extend the length $D_1$ along the side edges 350, 360 of the transparent cover 30. Side edges 350, 360 preferably comprise the loop member 351, 361 of a mechanical fastening device. The upper edge 401 of the flexible curtain 37 preferably comprises the hook member 40 of a mechanical fastening device. The loop member 351 and the interlocking hook member 40 form a fastener 35. Other design choices for fasteners 35, 36 could include snaps, zippers or other suitable means to allow for easy installation and removal of curtains 37, 38.

The curtains 37, 38 must be flexible enough to allow the insertion of the hands of the client 20 (FIG. 1) and the manicurist 21 (FIG. 1) through the access sides 44, 45 of the environmental chamber 23. The curtains 37, 38 must also be heavy enough to drape over the wrists or lower arms of the client 20 (FIG. 1) and the manicurist 21 (FIG. 1) to loosely seal the access sides 44, 45 of the environmental chamber 23. Enclosing the environmental chamber 23 by the curtains 37, 38 allows for the evacuation of fumes by a low volume exhaust motor and fan 39.

The hinged end wall 32 contains the exhaust motor and fan 39. The exhaust motor and fan 39 must be of sufficient power to evacuate the noxious fumes resulting from the nail treatment procedure yet quiet enough to provide no distraction or disturbance to the client 20 (FIG. 1) or the manicurist 21 (FIG. 1).

Dimensions $D_1$ and $D_2$ of the environmental chamber 23 must be such that an adequate work area 42 is provided the manicurist 21 (FIG. 1). $D_3$ must be sufficiently high to allow for the effective use of tools by the manicurist 21 (FIG. 1). $D_1$, $D_2$, and $D_3$ must also be such that the quiet, low volume exhaust motor and fan 39 will evacuate the work area of the noxious fumes.

The environmental chamber 23 with nominal dimensions $D_1$=27", $D_2$=16", $D_3$=9" to 12" provide an adequate work space. Said nominal dimensions also provide a space that can be quietly evacuated with a 110 cfm exhaust motor and fan operating at 3100 rpm.

Curtain 37 is partially folded back in FIG. 2 to reveal the hinge 33, the absorbent fibrous pad or towelette 34, the mechanical fasteners 351, 40 and the exhaust motor and fan 39.

Figure 4:
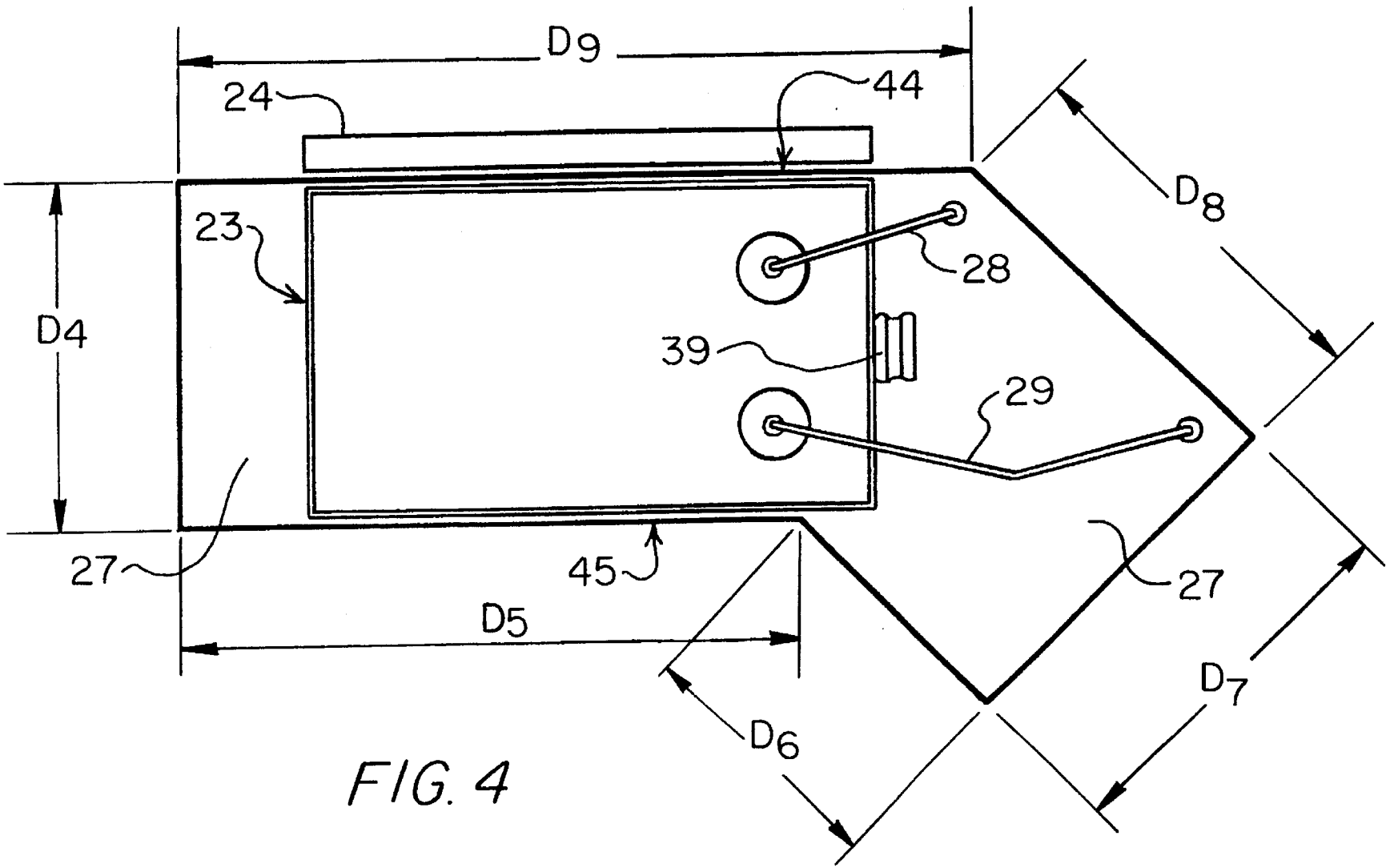
FIG. 4 is a top plan view of the environmental chamber and base unit as shown in FIG. 3.

Referring next to FIG. 3 the environmental chamber 23 is shown attached to the horizontal top 27 of the base unit 22. In addition to the horizontal top 27 the base unit 22 consists of a vertical panel 90 and a vertical panel containing storage drawers 91. The hinged end wall 32 contains the exhaust motor and fan 39 (FIGS. 2, 4). The manicurist can easily rotate the environmental chamber 23 upwards by grasping the end wall 31 and lifting upward. This allows for placement or removal of the absorbent fibrous pad or towelette 34.

A lamp 25 and a magnifying lens 26 are positionable over the transparent cover 30 to illuminate the work area 42 (FIG. 2) and to aid the manicurist 21 (FIG. 1) in observing the work area 42 (FIG. 2).

Storage drawers 43 are positioned at one end of the base unit 22. The storage drawers 43 provide support for the horizontal top 27 and provide for easy access to supplies required by the manicurist.

Referring to FIG. 4 the horizontal top 27 accommodates the placement of the retractable arms 28, 29. Placement of the retractable arms 28, 29 is such that interference with the manicurist 21 (FIG. 1) is avoided. Dimensions $D_4$, $D_5$, $D_6$, $D_7$, $D_8$, $D_9$ are such that an adequate area is provided on the horizontal top 27 of the base unit 22 (FIGS. 1, 3) for placement of the environmental chamber 23 and to provide adequate storage drawers 43 (FIG. 3) for the manicurist 21 (FIG. 1). Nominal dimensions $D_4$=16", $D_5$=28", $D_6$=12", $D_7$=16", $D_8$=18", $D_9$=36" provide an adequate area.

Although the present invention has been described with reference to preferred embodiments, numerous modifications and variations can be made and still the result will come within the scope of the invention. No limitation with respect to the specific embodiments disclosed herein is intended or should be inferred.

KEY TO DRAWINGS

20. Client
21. Manicurist
22. Base Unit
23. Environmental chamber
24. Arm rest for client
25. Lamp
26. Magnifying lens
27. Base unit top
28. Retractable arm for lamp support
29. Retractable arm for magnifying lens support
30. Transparent cover
31. End wall
32. Hinged end wall
33. Hinge
34. Absorbent fibrous pad
35,36. Mechanical fastener along side edge of transparent cover
37,38. Curtain
39. Exhaust motor and fan
40. Mechanical fastener along top of curtain
42. Work area under enclosed environmental chamber
43. Storage drawers
44,45. Access sides of the environmental chamber
90. Vertical panel
91. Vertical panel containing storage drawers
350. Side edge of transparent cover
351. Loop member of mechanical fastening device
360. Side edge of transparent cover
361. Loop member of mechanical fastening device
401. Upper edge of flexible curtain

I claim:

1. An environmental chamber and base unit for eliminating fumes and dust at a manicure work station, comprising:

a transparent cover;

a first and a second end wall having edges of the end walls connected to and supporting said transparent top;

a bottom means;

a first and a second access side each interposed between the end walls;

a first and a second closure means covering said first and said second access side, thereby forming an enclosure;

an exhaust means connected to said enclosure;

said base unit having a horizontal top which comprises part of the bottom means of the environmental chamber;

bottom means further comprises a removable member;

said first and second closure means further comprises a removable fastening means attachable to said transparent cover:

said removable fastening means further comprises a hook and loop fastener;

said first and second closure means further comprises a flexible construction;

said first end wall further comprise a resting means unattached to said base unit and capable of being lifted upwards away from the base unit; and said second end wall further comprises a hinge attachment to said top of said base unit.

2. The environmental chamber of claim 1 wherein said removable member further comprises an absorbent pad.

3. The environmental chamber of claim 1 wherein said base unit further comprises:

a first supporting end;

a second supporting end attached to said horizontal top.

4. The environmental chamber of claim 3 wherein said first supporting end further comprises a vertical panel.

5. The environmental chamber of claim 3 wherein said second supporting end further comprises a vertical panel containing storage drawers.

6. The environmental chamber of claim 3 wherein retractable arm support means for a lamp and a magnifying lens.

7. The environmental chamber of claim 1 wherein said flexible construction further comprises a towel.

8. The environmental chamber of claim 1 wherein said transparent cover further comprises glass or other transparent material suitably treated to resist mechanical and chemical abrasion.

9. The environmental chamber of claim 1 wherein said exhaust means further comprises a quiet, low volume exhaust motor and fan.

10. The environmental chamber of claim 1 wherein said first and second end wall further comprise a height of 9" to 12" thereby enabling the functioning of a manicurist's tools.

* * * * *